US010043494B1

(12) United States Patent
McCabe

(10) Patent No.: US 10,043,494 B1
(45) Date of Patent: Aug. 7, 2018

(54) TREMOLO STOP AND STABILIZER

(71) Applicant: Geoffrey Lee McCabe, Hollywood, CA (US)

(72) Inventor: Geoffrey Lee McCabe, Hollywood, CA (US)

( * ) Notice: Subject to any disclaimer, the term of this patent is extended or adjusted under 35 U.S.C. 154(b) by 0 days.

(21) Appl. No.: 15/835,435

(22) Filed: Dec. 7, 2017

Related U.S. Application Data

(62) Division of application No. 15/493,123, filed on Apr. 20, 2017, now Pat. No. 9,837,054, which is a division of application No. 15/296,401, filed on Oct. 18, 2016, now Pat. No. 9,847,076, which is a division of application No. 14/945,035, filed on Nov. 18, 2015, now Pat. No. 9,484,007.

(51) Int. Cl.

| | |
|---|---|
| ***G10D 3/14*** | (2006.01) |
| ***G10D 3/12*** | (2006.01) |
| ***G10D 3/04*** | (2006.01) |
| ***G10D 1/08*** | (2006.01) |

(52) U.S. Cl.
CPC ..... *G10D 3/146* (2013.01); *G10D 1/085* (2013.01); *G10D 3/04* (2013.01); *G10D 3/12* (2013.01); *G10D 3/14* (2013.01)

(58) Field of Classification Search
CPC ..... G10D 1/085; G10D 3/04; G10D 3/12; G10D 3/14; G10D 3/146
See application file for complete search history.

(56) References Cited

U.S. PATENT DOCUMENTS 4,608,906 A * 9/1986 Takabayashi ..... G10D 3/146 84/297 R
4,928,564 A * 5/1990 Borisoff ..... G10D 3/146 84/313

* cited by examiner

*Primary Examiner* — Kimberly Lockett

(57) ABSTRACT

TREMOLO STOP is a contact pin based improvement integrated into the tremolo and/or its related parts, to adjustably make initial contact at initial position or at the zero point either in a fixed "hard stop" position that can be further adjusted to disengage from the body. The STABILIZER TUNER dynamic "soft stop" contact pin arrangement comprises a resilient element to provide a second variable force tension at the zero point of the tremolo. The contact pin is adjustable relative to the body. An adjustable stabilizer housing varies the second variable force of tension.

19 Claims, 5 Drawing Sheets

TREMOLO STOP AND STABILIZER

I, Geoffrey McCabe, claim for TREMOLO STOP AND STABILIZERS, based on the parent application, McCabe U.S. application Ser. No. 14/945,035, Nov. 18, 2015, issued as U.S. Pat. No. 9,484,007, Nov. 1, 2016, for Species III election entitled TREMOLO STOP TUNER AND TREMOLO STABILIZER, Divisional application Ser. No. 15/296,401, Oct. 18, 2016 entitled, TREMOLO SPRING AND STABILIZER TUNERS comprising Species I, II and IV as well as Continuation In Part Divisional application Ser. No. 15/493,123, Apr. 20, 2017 entitled, HEADPIECE AND MAGNETIC TUNERS.

The instant application is directed to completing an area of the Ser. No. 14,945,035 parent application: presenting improvements for maintaining initial position of a tremolo under various requirements comprising the biasing element or tremolo springs, comprising a first variable force of tension, countering the force of the tension of the strings collectively tuned to pitch.

Individual to this particular application, the entire stabilizer apparatus is variably secured to a tremolo and/or integrated into the tremolo itself to support this set of novel tremolo innovations.

The application focuses on a threaded contact pin element based apparatus, integrated into the tremolo and/or its related parts, to adjustably make initial contact at initial position or the "zero point" either in a:

1) Fixed "hard stop" position that can be further adjusted to disengage from the body; or
2) Dynamic "soft stop" position within an adjustable stabilizer housing apparatus wherein the resilient element providing the second variable force of tension can be further varied.

Each of these arrangements installed on the instrument providing an adjustable elastic pre-load to meet individual second variable force of tension requirements.

The magnetic adjustable stabilizer apparatus is discussed:

The General Background of the Invention indicates not only the use of more common resilient elements like coil springs, etc. in devices secured to the spring pocket, etc. but also the magnetic elements in otherwise similar apparatuses to create a variable force of tension to enforce or stabilize a tremolo, page 13: "The Mag-Lok from Super-Vee Tremolos, secured to the spring pocket, US patent pending, is a magnet-based alternative to the compression spring arrangement to ensure the tremolo in initial position or the "zero point" during double stop bends and the like that is overcome when the bar is used."

McCabe Ser. No. 15/296,401 presents magnetic fields of two matching poles in proximity to each other exert a force in the direction of the poles. The Magnetic Stabilizer Apparatus can comprise magnetic elements in proximity to vary the torque they exert on each other to create a variable resilient magnetic force as discussed below.

The General Background of the Invention of the parent application has been embellished with additional phrases, etc. to support the subject matter more clearly; the section on the Mag-lok [p. 18-19] has been expanded to introduce claim terms and detail related concepts.

In the Summary Of the Invention, Stabilizer Tuners [pp. 23-24] section is added to support claims.

Claims 1-5 are directed to for the use of contact pin element variably secured to the tremolo comprising a stop operable to make initial contact with the body of the instrument or the "zero point" to impede rotation of the tremolo in one direction from initial position and can be alternatively varied into a disengaged position. The contact pin element can be repurposed to variably support a separate spring holder, the holder element operable to make initial contact at initial position forming the adjustable stop. The contact pin element forms a thumbwheel.

Claims 6-12 are for stabilizing and maintaining initial position of the tremolo at time of initial setup. The elasticity of the force of tension by the resilient element behavior is operable to form an elastic pre-load as a second variable force of tension in the apparatus accordingly. The contact pin, guide and housing elements limitations along with a thumbwheel and separate spring holder are further claimed.

Claim 14-15 are for an "or" claim for limitations, such the adjustable contact pin element threadedly connected to the tremolo, and moveable therewith, operable to make initial contact at initial position, comprising either 1) a stop mechanism to eliminate rearward tilt of the tremolo or 2) a stabilizer apparatus, adding a pre-tensioned resilient element to exert a second variable force of tension, to limit the first variable force of tension during rearward tilt. Claim 15 limits the pre-tensioned resilient element as comprising a magnetic element arrangement. Claim 16 to limit the first magnetic element as at least one member in the group of stabilizer elements, the group of elements comprising the contact pin element, the resilient element and the stabilizer housing element.

Claim 16 is an independent claim for a magnetic stabilizer arrangement wherein both the first and second magnetic elements are in close proximity on the tremolo itself.

Claims 17-19 is for the Global Tuner Pro model (of the original application) comprising the spring block and secondary spring holder/thumbwheel arrangement comprising a spring loaded as well as a magnetic resilient element in a dual stabilizer apparatus where the both the contact pin element position for making initial contact and the housing position for varying the rate of the second variable force of tension are adjustable for individual requirements.

Amended figures based on the figures from the parent application and continuations are included with updated numbering. Description of the Drawings has been amended accordingly.

GENERAL BACKGROUND OF THE INVENTION

In a stringed musical instrument, such as a guitar, the strings, placed under tension, extend unsupported between a first critical point usually formed by the nut positioned where the neck joins the head and a second critical point usually formed by a clearly defined point on the bridge positioned on the body. The strings are secured or fixed at one end on the body of the instrument to what is traditionally known as the tailpiece, strung over the bridge and extended past the nut at the transition from the neck instrument to the head, and, for conventional instruments, secured at the other end to the tuning pegs where an untensioned string is tensioned and adjusted to a tuned pitched condition, proper playing pitch for play, or, simply, tuned condition; sometimes a nut arrangement is provided for a headless or tuning peg-less design. The neck further comprises a fingerboard or fret board that a player presses the strings against to play various pitches up and down the neck; the fingerboard typically is formed with a convex radius that commonly varies between 9" and 16".

The second critical point can be created as a part of a bridge or combined bridge and tailpiece structure. Traditionally, the size of the bridge element is quite small so as to create a clearly defined single point of contact between the string and the bridge element. It is between these two points that the playable string length is typically determined, sometimes referred to as the scale length or harmonic length. Adjusting the relative distance between the first and second critical points is called harmonic tuning or setting the intonation. Some bridges structures are individually adjustable, that is for each string, relative to the nut for achieving a more precise harmonic tuning. Usually this adjustment of the second critical point for harmonic tuning is carried out first and then the strings of the instrument are tuned to playing pitch. Often referred to the "initial setup", it is not uncommon that further adjustment of the harmonic tuning is necessary for a variety of reasons, for example, including changing the brand of a string where the alloy of the strings is varied or when the gauge of strings the player chooses changes as well as "setting" the string by manually pulling on the string along the scale length in order to improve elasticity in the string at first tensioning before the string can confidently relied on to hold proper playing pitch during the life of the string.

Often the typical construction of the strings, particularly for guitar and bass, includes a plain end and, on the other end, a "ball end" which being a washer-like addition is wrapped by the string itself into a larger form to enable "fixing" or securing the string on the instrument to the tailpiece element; alternatives to the "ball end" include as known to those of ordinary skill in the art as "bullet ends" formed from metal and molded around the end of the string. The tailpiece is usually provides for an opening or recess sufficient in size to receive the strings of various diameters ranging from 0.007" to 0.070" or more while being smaller than the diameter of the ball end so as to limit the passing of the ball end through the opening or recess in order to secure or mount each of the individual strings to the body. The wrapping usually extends up to a ½" towards the plain end and as such the position of the tailpiece structure relative to the bridge element must insure that the wrapping does not extend over the second critical point when arranged on the instrument; this wrapping, under normal circumstances, is not subject to stretch compared to the rest of the string. In the relevant art, "anchoring" strings is often referred to as attaching or securing a string and understood with the limitation that the anchoring is sufficient so that the string is fixedly attached or secured to the instrument under the typical tensioned conditions of the string that typically range from 16 to 20 lbs or greater. Stable fine adjustments of these and other elements have been a longstanding problem for stringed musical instruments.

Additionally, the popularity of guitars and other multi-stringed instruments having more than the typical 6 strings and/or using longer scale lengths, etc. are capable of a greater pitch range which creates the need for strings of a larger diameter. One solution is to utilize "taper core strings" that have one or two less layers of wrap near the "ball end" of the string to go over the bridge elements. Further, a "taper wound" string simply tapers away these layers of wrap as near the ball-end of the string, so the part that goes over the bridge has a smaller diameter. "Exposed core" strings taper down to the core itself, so the core goes over the bridge and lowers the action and increases sustain/resonance. These designs are often seen on B strings, typically a low string on a five string bass, for example. The logic is that a taper core string, etc. approach will help with intonating a larger diameter string. In some of these cases the strings are mounted to tailpiece portion by inserting the string through or over the bridge elements to avoid complications due to increased string diameter. The larger diameters can be problematic given the dimensions of vintage systems.

Playing pitch or proper playing pitch or pitched string condition is generally understood by one of ordinary skill in the art to be the proper pitch of a guitar string relative to the remaining guitar strings when a guitar is played "in tune." For example, in a standard tuning arrangement, for a six string guitar, based on the standard A=440 Hz, the playing pitch of the $1^{st}$ string (highest) is tuned to note E (329.63 Hz), the playing pitch of the $2^{nd}$ string is tuned to note B (294.94 Hz), the playing pitch of the $3^{rd}$ string is tuned to note G (196.00 Hz), the playing pitch of the $4^{th}$ string is tuned to note d (146.83 Hz), the playing pitch of the $5^{th}$ string is tuned to note A (110 Hz), and the playing pitch of the $6^{th}$ string is tuned to note E (82.41 Hz).

In the Proelsdorfer U.S. Pat. No. 2,304,597, string tensioning devices placed on the tailpiece for fine tuning the pitch of the strings of violins, guitars and the like, were disclosed; such pitch adjustment is quite limited in range, comprising generally an interval falling between that of a whole tone and a major third at best, and designed to offer the tuning of the strings a minor adjustment of pitch after the general tuning is achieved with the tuning pegs on the head of the instrument which traditionally first provides for raising and adjusting the tension of the strings to pitch from an untensioned condition and then setting the string. This is regarded as fine tuning and the apparatus for doing so, the "fine tuners", usually comprise an adjustment knob or thumb screw.

It is known to those skilled in stringed musical instrument design and construction that various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the fulcrum tremolo, first introduced in Fender U.S. Pat. No. 2,741,146 ("Fender '146") shows and provides a device comprising a novel structure, which incorporates the bridge and the tailpiece. The portion supporting the bridge elements is called the bridge plate or the base plate. Further, both the bridge and the tailpiece elements connected to the base plate both move together as the fulcrum tremolo device is pivoted. Typically, in order to facilitate the fulcrum tremolo pivoting about its fulcrum axis, counter springs, as a biasing element, are utilized to counteract or counter balance the pull of the strings. Accordingly, a singular and defining aspect of the fulcrum tremolo is that the harmonic tuning is upset as the device is pivoted; and, accordingly, for an instrument equipped with a fulcrum tremolo, it is unique in that only restoring all of the strings to a proper pitched condition also simultaneously restores the harmonic tuning for all the strings. The base plate upon which the individual bridge elements are adjustably secured has a beveled ridge portion which is secured to the instrument body by six screws permitting pivotal movement about a fulcrum axis which varies the tension on the strings and produces the desired "tremolo effect"; in general, this device allowed for extensive dropping down of the pitch of all the strings and a modest upward capacity that further enabled the familiar mild pedal steel or Hawaiian guitar vibrato effect provided in gentle pivoting.

In this first vintage fulcrum tremolo, herein referred to as Type I, the metal bridge elements of Fender '146 are loosely held in place by a spring loaded attachment screw arrangement pivotally secured through openings in a small folded portion of the base plate farthest from the fulcrum axis. The bridge elements also incorporate set screws for varying the relative height of the bridge elements and, therefore, height of the respective second critical points relative to the base plate and by extension, to the body and neck.

The fulcrum tremolo is generally defined to have a base plate pivotally mounted to the body of the instrument and an "inertia block" or "tone block" or "spring block" that extends transverse the direction of the strings 90° to the base plate. The instrument body is fashioned to include a single body cavity comprising two distinctive sections. There is 1) an approximate 3.00"×1.00", generally rectangular, transverse the direction of the strings, traditional "tremolo pocket" or "trem pocket" extending generally perpendicular from the top surface of the body to meet at 90° providing two approximate 3.00" wide opposing faces, a first face closer the nut and a second face further the nut; and 2) the traditional, generally rectangular, approximate 4.00"×2.25"×0.775" deep, cutout extending in the direction of the strings in the back of the instrument body, a "spring pocket", to receive the spring arrangement. The spring block has a first surface closet the nut and a second surface, each surface generally perpendicular to the top of the instrument and generally parallel to the tremolo pocket first and second face. Although there are differences in specifications from one instrument manufacturer to another for the various designs of the fulcrum tremolos that are available, there is approximately 0.125" to 0.250" clearance, between the spring block and the tremolo pocket face closest to the nut, to provide for upward pitch change as the spring block pivots towards the nut. Counter springs are usually connected to the body of the instrument at one end and, on the other end, to a separate spring attachment means transverse the base plate, usually a block of metal, milled or cast or a combination of the two, which being secured to the bottom of the base plate by three screws 90 degrees to the base plate, is often called a spring block or inertia block.

The typical spring arrangement includes, in addition to the biasing springs connected to the spring block, a "spring claw" to receive the other end of the biasing element secured by two wood screws to adjust the position of the spring claw relative to the body for a simple but cumbersome adjustment method. There is ample room for the spring block to pivot freely within the "tremolo pocket" cavity during use.

One of the most troublesome problems with prior art for the fulcrum tremolo has been maintaining the "initial position" or the "zero point" achieved at "initial setup" when all the strings are brought to proper playing pitch as the harmonic tuning is achieved. When a musician plays on the string there is usually some kind of string stretch over time that results in the overall tuning, and thereby, the "initial position" going out of balance. Specifically, when the pitch of the string changes, the position of the fulcrum tremolo and the position of the second critical point relative to the nut changes which then instantly alters the harmonic tuning. This is especially problematic if a string breaks with this type of tremolo; since the missing force otherwise created by the tension of the broken string allows the entire tremolo to be subject to the known "backward tilt", all the remaining strings are un-manageably sharp in pitch and the harmonic relationship to the fret placement and scale length is distorted, generally, to an undesirable degree. Furthermore, when the tremolo base plate tilts forward, the spring block tilts away from the nut; and when the tremolo base plate tilts rearward, the spring block tilts towards the nut.

This singular characteristic adds complexities in obtaining the primary goal of achieving a stable equilibrium, initial position, between the force of the tension provided by the use of two to five biasing or counter springs (connecting between the tremolo and the body) in relation to the force of tension of all the strings (connected to the fulcrum tremolo and the end of the neck at the peg head by the tuning pegs or an optional nut arrangement that secures the strings without tuning pegs, etc.)

Accordingly, these and other inherences need to be addressed in achieving a true and lasting initial position for the fulcrum tremolo and has been the object of many inventions. In this inherent inter-dependant system of tensioning forces, contrary to the requirements of other tremolo or fixed bridge arrangements, (in the ideal instance where the essential conditions of the initial setup have been established and the appropriate tensioning force of the springs provisioned), the precise tensioning to proper playing pitch for any less than the total number of strings will inherently fail to achieve pitch and harmonic tuning for all of those strings attached to the tremolo.

Often the pivot is subject to wear and the tremolo does not always return to its initial position. Great care is required to establish the initial position, since both aspects of adjustment are interactive for "floating tremolo setups", and since it simultaneously provides both the proper harmonic tuning and proper pitch tuning for each of the individual strings in order to enable a lasting "initial setup".

Therefore, for stringed musical instruments, as is known to those skilled in the art:

The second critical point is a clearly defined point on the bridge or individual bridge elements, the adjustment of which relative to the first critical point on the nut defines the length of the string or scale length and the adjustment of which is called harmonic tuning.

For fulcrum tremolos as originated by Fender U.S. Pat. No. 2,741,146, when pivoted:

Both the bridge portions and the string anchoring means, the tailpiece, simultaneously move about a common fulcrum axis;

The harmonic tuning is upset and is only restored when all strings are at proper playing pitch;

The tuning pegs or other means of tensioning the strings are inter-dependant with each other in obtaining initial position; and Various factors can disturb the equilibrium point between the tension of the strings and the tension of the counter springs and as a consequence disturb the initial position.

For those fulcrum tremolos equipped with fine tuners as with Rose U.S. Pat. No. 4,497,236, Storey U.S. Pat. No. 4,472,750 and Fender U.S. Pat. No. 4,724,737:

The bridge and tailpiece portions simultaneously move about the fulcrum axis when the device is pivoted for the tremolo effect;

The fine tuner screws simultaneously move with the bridge and tailpiece portions about the tuning axis when fine tuning; and Fine tuners are designed to offer the tuning of the strings a minor adjustment of pitch after the general tuning is first achieved, typically, by the tuning pegs on the head of the instrument; and Adjusting the tension of a string by the fine tuner knob alone simultaneously adjusts the harmonic and pitch tuning and can achieve tuning a string to proper pitch conditions while simultaneously achieving proper harmonic tuning.

Improvements to the Fender '146 fulcrum tremolo have included Rose's "string clamps" at the nut, installed along with a "string tree" for some guitars, a horizontal bar positioned between the tuners and the "locking nut" arrangement, to facilitate stability and "string clamps" at a point on the opposite side of the intonation point or second critical point on each of the bridge elements relative to the nut in order to limit string stretch to the prime vibratory portion of the string within these two points defining the scale length.

Knife Edge Pivots for the Fulcrum Tremolo

Rose (U.S. Pat. No. 4,171,661) shows adopting a novel shaped beveled edge to the base plate, called a "knife edge", adjustably supported by two screw-like members, referred to generally as riser posts, positioned in the body to collectively improve the return to initial position after pivoting the fulcrum tremolo device. The knife edge fulcrum pivot arrangement provides for the base plate to be positioned generally parallel to the instrument body, often referred to as a "floating tremolo", for example, and offered the novel possibility to substantively increase the tension of the string for upward pitch changes by rocking the base plate "rearward towards the body" with the arm. The inclusion of iterations of Fender '146, herein referred to as Type I, to include, similar to Rose, a knife-edge design on the leading edge, closest to the nut, of the base plate with a riser post arrangement adjustably connected to the fulcrum tremolo, herein referred to as Type II.

These two vintage fulcrum tremolos of the last century, Fender in the 50's and Rose in the 70/80's, are in part distinguished by the differing standards for the placement of the riser posts, that receive each of the knife-edges to create a pivot axis, relative to both first critical point on the nut as well as the second critical point on the bridge element. Accordingly, there are differences in the body pocket but less so for the cutout that receives the biasing springs and the distance from the face of the spring block nearest the nut to the corresponding face of the tremolo pocket.

DETAILED BACKGROUND OF THE INVENTION

The Stopped Tremolo

It is also known that many musicians, despite having the requisite hardware on their stringed instrument to enable a "floating tremolo" setup, intentionally choose to "block" or "stop" the fulcrum tremolo from being tilted "rearward" in order to remove the potential for an unwanted increase in pitch of the strings. This condition or setup is commonly referred to as a "blocked tremolo" or "stopped tremolo"—accordingly, the stop is considered a "hard" stop when it completely prevents pivoting the tremolo in one direction when at initial position or the "zero point". Additionally, as a significant part of this setup, increasing the overall tension of the biasing element past the minimum force required to make initial contact with a "hard" stop at initial position, is required to compensate for the increases in force in the tension string during bending notes, etc. meeting at least three objectives: 1) when a string breaks, the tremolo stop will ensure initial position, so that tremolo does not tip rearward and the rest of the strings do not go up in pitch, despite the missing counter balancing force of the untensioned or broken string, 2) ensuring the tremolo returns to initial position after radical use no matter what—to eliminate, among other things indigenous to the floating tremolo, the maintenance and care of initial position over time defined by the delicate balance of the forces and related wear and tear over time and 3) to make the tremolo less likely to be activated unintentionally compared to a floating tremolo, useful in general, for strumming, and makes double stops much more accessible when the force of the biasing element is increased. Tremolo stops of this nature have been created by small pieces of wood, plastic, etc. approximately 0.125" ~0.250 or so thick which have been placed in the tremolo pocket between the spring block and the face of the tremolo pocket closest to the nut—even in "emergency" situations, a stack of guitar picks taped to the inertia block's face closest to the nut, in sufficient dimensions, can used for an evening, if need be.

Further, stopping a floating tremolo is common to meet the demands of auxiliary tension adjustment mechanisms: U.S. Pat. No. 5,359,144 ("'144") October 1994 to Robert Benson. Commercialized as the "D-tuna" mechanism for the "double-locking" Floyd Rose tremolos, the mechanism is designed to quickly re-tension the $6^{th}$ string from standard "E" down a whole step to "D" for "drop-tunings", ie., instances where the pitch of at least one string is varied compared to standard tuning—the dynamics of the forces of tension between the strings and springs require, for optimal usage, a stopped tremolo:

> A pitch changing apparatus, providing bi-stable operation within a tremolo system which produces two distinct pitches for selected strings . . .
>
> In the Abstract:
>
> The tension correcting mechanism is manually rotated to adjustable stop positions of required spring counter-tension, thereby keeping all strings in tune under conditions of changed total string tension.
>
> Van Halen: (http://www.dtuna.com/faq.php):
>
> Why do the other strings go out of tune when I drop to D?
>
> The bridge must be stabilized first. This is done by blocking the bridge so it cannot pull up. If your bridge is stabilized and the other strings are still going out of tune, you may need to increase the overall "spring tension" by moving the spring claw further from the block.

Accordingly, it is recommended by Van Halen that the "D-Tuna" device of '144 works better with an additional element or mechanism that will provide a "hard" stop the tremolo when the $6^{th}$ string is tuned to "D", the lower of the two target pitches; and, in order to ensure initial position of the fulcrum tremolo at the higher target pitch, since a hard stop requires increasing the overall force of the biasing element sufficient to compensate for the small increase in force, which unaddressed would yield a forward tilt otherwise present at the higher-tensioned "E" target pitch.

Floating Tremolo and Tremolo Stabilizers One disadvantage, for some players, is that a "hard" stop eliminates the original capacity for light tremolo wavering effects around initial position and upward pitch bends. Accordingly, many players today would prefer a setup that acts like a fixed bridge for small force changes like bending strings, strumming at initial position yet "gives" and acts like a floating tremolo for using the tremolo arm for larger modern, pitch changes, such as "dive bombs", as is distinguished as a "soft" stop or tremolo stabilizer. As is known, the biasing element or spring system, provides a continuous generally linear force curve to establish equilibrium at initial position or the "zero point", but is not capable of changing its rate of tension, in general, stretching gradually and gradually as more force is applied.

Various mechanisms have been presented to assist the traditional biasing springs of Fender '146 in view of modern demands, such as the Hipshot branded "Tremsetter", Borisoff et al, U.S. Pat. No. 4,928,564 ("'564"). The Tremsetter device secured directly to the body's spring pocket, provides an adjustable pre-tensioned compression spring element added to complement the traditional biasing element to provide a discontinuous force curve exerted on the tremolo in order to provide an adjustable "soft" stop or tremolo stabilizer—the spring arrangement operable to increase the force required to pivot the fulcrum tremolo from initial position; its operability primarily to more firmly maintain the initial position of the floating tremolo compared to usage with an unassisted biasing element. Accordingly, when a force is exerted to move the tremolo out of initial position, that same tremolo is subject to a restoring force that is being borne by the stabilizing device limited enough in its range so that the compression spring element is active until the pre-tensioned restoring force is overcome during operation of the tremolo.

The Hipshot device and multi-spring variations like it, the Ibanez BackStop, the WD Tremolo Stabilizer, the ESP Arming Adjuster, the Goeldo BackBox, not all of which are available in the US at this time, none-the-less all comprise a compression spring-like arrangement deployed to complement the traditional biasing element, each secured to the tremolo spring pocket, tensioned upon installation to an approximate force of 8~10 pounds, capable of making variable contact with the spring block and urging the spring block in a direction away from the nut—these devices do not pivot with the tremolo about its axis—it requires approximately 4 pounds of force to "bend" a typical electric guitar unwound string a whole tone up in pitch under typical situations, 8 pounds or so of force will reinforce or ensure initial position under the conditions where two strings are bent.

Each such device employs a tensioned compression spring that seeks to stabilize initial position with an adjustable "soft" stop, to avoid the limitations of a 'hard" stop and to offer more stability in the instance of double stops which are otherwise more difficult:

> A method of stabilizing a neutral position of a tremolo system including a pivoted bridge assembly including the steps of tensioning all of the strings of a guitar to a selected pitch slightly less than a desired pitch, tensioning certain counter-balance springs connected between said bridge assembly and the guitar body to oppose the string tension, and mechanically adjusting a certain counter-balance spring to bring the tension in the guitar strings to a desired pitch whereby said mechanical adjustment provides a mechanical stop for returning all of the guitar strings to a selected pre-tuned pitch.

Numerous other complementary mechanisms are secured to the tremolo spring pocket to enforce the position of the spring block such as Hirayama U.S. Pat. Nos. 6,552,252 and 6,686,524 for Ibanez include auxiliary springs to enforce initial position. Geier U.S. Pat. No. 7,427,703 commercialized as the "Tremol-no" releasable tremolo stop is also secured to the tremolo spring pocket in the body:

> A quick-release tremolo lock device for installation into a tremolo recess, and for mounting to a movable bridge or a tremolo block of a stringed instrument such as a guitar. The tremolo lock device includes a spring mount that is adapted to be fixedly attached to at least one wall of the tremolo recess and configured to capture an end of at least one tremolo spring. A slide key is also incorporated into the device, which is connected to the spring mount about a proximate portion of the slide key. The device also includes an adjustable quick release slide receiver that is adapted to receive and to releasably capture a distal portion of the slide key to fix the position of the receiver relative to the slide key. The device further includes a tail piece joined to the quick release slide receiver and configured to be mounted in a spring hole of the tremolo block.

Lavineway U.S. Pat. No. 718,990 is provides a tension bar connected to the body operable on the spring block to ensure initial position:

> A tension bar is held against the back of a lower portion of the tone block by at least one tension bar spring when the tone block is in a neutral position. Stopping means are provided to prevent the tension bar from urging the tone block forward of the neutral position.

The Mag-Lok from Super-Vee Tremolos, secured to the spring pocket, US patent pending, is a magnet-based alternative to the compression spring arrangement to ensure the tremolo in initial position during double stop bends and the like that is overcome when the bar is used.

Smith U.S. Pat. No. 9,029,671 provides for a device secured to the "upper surface of the body" adjustably connected to the tremolo base plate operable to selectively stop a floating tremolo:

> A tremolo lock as provided preferably to allow the operator to engage the lock or stop from the topside of a guitar and tremolo base plate completing a floating double locking tremolo system preferably for electric guitars.

The Hipshot Tremsetter is also known to be installed with the D-tuna in order to improve the accuracy of the predetermined target pitches for a floating tremolo. Dam's U.S. Pat. No. 7,053,287, also secured to the body's spring pocket, for a similar device secured to the spring pocket for creating a soft stop include:

> A compensator for a tremolo for a stringed musical instrument, such as an electric guitar. The compensator has an integrated tremolo stop, allowing a musician to continue playing without undue delay in the event a string breaks.

Further,

> The object of the present invention is to provide a compensator having an integrated tremolo stop which allows the musician to resume playing with a minimum of delay after string breakage, and to provide ready access to the tremolo stop while keeping the number and size of the openings as small as possible.

Didan U.S. Pat. No. 6,943,284 September 2005 for a retractable tremolo stop mechanism comprising a retractable cam adjustably secured to the top body surface bracketed between the spring block and the base plate:

> . . . having a first inoperative position and a second operative position in which it stabilizes the bridge plate by limiting movement of the bridge plate in one direction in response to the spring means, means for maintaining said cam in said first position and said second position comprising of a frictional restraint in contact with said cam, method for establishing the normal position of the bridge, The cam is selectively operable by the player between an inoperative (retracted) position, and an operative position in which it serves to stabilize the bridge plate.

The cam is pre-set with a limit stop whereby its actuation stabilizes the bridge plate at a position providing for normal tune of the remaining strings despite the failure of any one or more strings, or for purposes of tuning the instrument.

Rose U.S. Pat. No. 8,946,529, February 2013, apparatus includes a modification of his fulcrum tremolo for top mounted Gibson-style applications to include a re-enforcing element for initial position—this design obviates the traditional spring block that pivots within the body of the instrument and the biasing element arrangement:

The apparatus includes a mounting frame configured for mounting on the surface of the body of the instrument, an attachment post secured to the body, a base plate pivotally mounted with respect to the attachment post and having a surface adapted to receive a force, a mounting assembly mounted on the base plate for holding a string of the instrument, and a first resilient member assembly for engagement with the mounting frame outside the body of the instrument and supplying a stabilizing force to the base plate against a tension force in the string. The apparatus includes a second resilient member assembly configured to be engaged with the mounting frame outside the body of the instrument and to supply a force to the base plate surface adapted to receive the force.

As discussed above all of the various compression spring based mechanisms described above are secured to the body, in the spring pocket, in particular, and, accordingly, do not rotate with the tremolo at any time, to make variable unsecured contact with the spring block to apply an expanding force supplied by compression springs against the spring block in a direction way from the nut to augment the linear force applied by the biasing element pulling in the direction towards the nut. In each case the adjustment members are very small, often positioned between the individual springs of the biasing element and difficult to adjust initially and to compensate for changes over time.

The Global Tuner invention offers a quick way to adjust the dynamic relationship between tensioning forces between the strings and springs with a thumbwheel to maintain "initial position" over time. The typical Global Tuner splits the tremolo's inertia or spring block into two sections transverse the direction of the counter springs. One section is a base element or main block that is connected to the tremolo base plate and the other section comprises a holder element connected to the biasing element or counter springs, in a format that is connected to the main block and which is, in either case, adjusted by a thumbwheel arrangement. (See Advanced Global Tuner—U.S. patent application Ser. No. 14/687,776 Apr. 28, 2015). Since acoustic coupling is best in the instance of the greatest contact between the associated parts, when the spring holder element is slideably positioned within, say, 0.031" of the base element, a first position, when the assembled parts have the greatest contact area to each other. Threading the thumbwheel to variably position the holder element in either direction will restore initial position under normal conditions while maintaining the best coupling for this design.

The Global Tuner provides a variable adjustment mechanism invention that neither meets the requirements to achieve a stopped initial position nor a "soft" stopped initial position—the need for a stable and adjustable tremolo stop tuner is clear.

SUMMARY OF THE INVENTION

Tremolo Stop and Stabilizers

One improvement is directed towards a Tremolo Stop comprising a threaded contact pin element operable to variably contact the body with the capacity to stop or block the tremolo at initial position.

A first embodiment comprising primarily an adjustment member or, alternately, a thumbwheel, threadedly connected to a tremolo or spring block, for example, and moveable therewith around the tremolo pivot axis, the adjustment member extending in the direction towards the nut, by, say, 0.125~0.250", according to individual specifications, making initial contact with a tremolo pocket face in initial position, operable to form a "hard" stop preventing rotation of the tremolo spring block towards the nut; a set screw is used to secure the position of the stop and improve acoustic coupling. The adjustment member, threadely or pivotally connected to the spring block, the adjustment element can comprise a tip operable to make initial contact with the inner first face of the tremolo pocket closest the nut to stop a tremolo from pivoting in one direction when at initial position. A setscrew can be added as referenced above.

In another alternative embodiment, a holder element separate from the spring block base element includes the adjustment member or a thumbwheel element. Either the extended portion or the tip is adjusted towards the tremolo pocket face and away from the base element to make initial contact. A set screw, threadedly positioned in the base element and in variable contact with the thumbwheel adjustment mechanism, is threaded in a first direction to fix the position of the extended portion at initial contact to form a stop to impede rotational movement in one direction from initial position. Re-adjusting the biasing element with the traditional adjustment screws in spring claw arrangement, as discussed above, is required to increase the tension to further exploit the advantages of a "hard" stop setup.

Another over all improvement is directed to resilient elements that can comprise compression spring based stabilizers, secured to the spring block and various arrangement, operable to make initial contact with a surface in the tremolo pocket with a limited pre-determined force operable to ensure a "soft" stop at initial position, supplementary adjustment features are further disclosed. The compression spring element complements the biasing element to comprise a limited discontinuous force operable to increase the force required to pivot the fulcrum tremolo from initial position during rearward tilt. The "soft" stop or tremolo stabilizer arrangement comprising, for example, compression spring arrangements including the use of spring plates in various shapes, sizes, etc., secured to the main block, and moveable therewith, to complement the force of the biasing element at initial position Accordingly, when a force is first exerted to move the tremolo out of initial position, that same tremolo is immediately subject to a restoring force that is being borne by the stabilizing device limited enough in its range so that the compression spring element is active until the pre-tensioned restoring force is overcome during operation of the tremolo.

In one embodiment, the compression spring element is pre-determined compressed in a form comprising at least one L-shaped spring steel-like plate, extending generally towards the nut, with a short leg connected to the spring block and/or the base plate and a longer leg extending downwardly towards the biasing element within the first face of the tremolo pocket, bent sufficiently to comprise a pre-determined force expanding against one of the faces within the tremolo pocket at initial position, that in combination with the biasing element creates a discontinuous force sufficiently focused on a small rotational field to reinforce initial position and mild enough to allow the player to utilize the tremolos' intended capacities more fully. Given that the tension of the L-shaped plate is fixed or per-determined by its shape and thickness of material and the distance to the front face from the tremolo block is somewhat varied, and that the final outcome of active pre-tension at initial position is further altered by variables such as the gage of strings, the number of springs used in the biasing element, etc., a set-screw extending through the main block to make variable contact with the L-shaped spring will variably affect the active length of the longer leg to offer adjustment of the operable force. Further, adjusting the spring claw screws for adjusting the force of the biasing element in the spring pocket will inter-cooperate with the force of L-shaped spring steel-like plate applied to the face of the tremolo pocket to reinforce initial position for strumming and light tremolo action.

A more adjustable embodiment of the tremolo stabilizer comprises a pre-determined pre-tensioned compression spring clip-like element secured to the extended portion operable to make initial contact with the tremolo pocket face at initial position. This arrangement reassigns the thumbwheel adjustment member of the Tremolo Stop Tuner to instead variably position the clip-like compression spring arrangement relative to the inner face of the tremolo pocket to alter the force of the pre-tension. The setscrew arrangement fixes the position of the thumbwheel and couple the device to the instrument. Alternately, say, a removable 2 mm thick foam rubber strip, or such with sufficient elasticity could be positioned on the extended portion operable to comprise a force sufficient to reinforce initial position for stabilized strumming, etc.

The Tremolo Stop Tuner holder element further comprising a secondary spring holder along with the set screw and thumbwheel improvement can alternatively comprise an advanced Global Tuner—to switch setups 1) release the fixed position of the "hard" stop by loosening the setscrew to 2) allow free rotational movement of the thumbwheel in order to 3) threadedly withdraw the stop and, thereby, the holder element, to a position free from limiting the rotation of the tremolo 4) re-adjust the traditional spring claw arrangement to reduce the force applied by the biasing element to convert the biasing element position arranged for the stop into a position suitable for a Global Tuner, 5) thread the thumbwheel, and as needed over time, and 6) maintain setscrew to fix and couple the apparatus to finish the setup. As is known, a "soft" stop/tremolo stabilizer is incompatible with a "hard" stop setup. It is important to understand the two applications are mutually exclusive to each other such that neither feature can be deployed at the same time, nor changed "on-the-fly", due to these opposing setup requirements.

In a preferred embodiment, for a fully adjustable soft stop, an independently adjustable pre-determined or pre-tensioned internal compression spring arrangement comprising a Tremolo Stabilizer is presented. The Tremolo Stabilizer comprising a housing threadedly secured to the spring holder extended portion or alternatively to the main block. The most preferred arrangement having a housing, a washer and coil or wave spring at one end, a support collar or guide element variably positioned within tensioner element and the formed openings in the extended portion, an adjustment pin threadely connected to the collar operable to variably extend the adjustment pin to the tremolo pocket. The adjustment pin comprises a rounded tip often and sometimes comprises a ball bearing element. The device includes the compression of the internal compression spring within the housing of the Tremolo Stabilizer to comprise a pre-determined force of approximately 4 pounds determined at the factory at the time of assembly. A player can adjust the pre-tensioned condition of the compression spring by rotating the housing. Accordingly, the apparatus comprises a limited discontinuous force operable to increase the force required to pivot the fulcrum tremolo from initial position. Since the adjustment by the tensioner element of the force of the internal compression spring is independent of the adjustment of the forces of the biasing element, the thumbwheel is free to be operable to re-establish initial position on the fly without altering the integrity of the finely adjusted pre-tensioned forces of the spring arrangement.

Stabilizer Tuners

The Tremolo Stabilizer is directed to creating or enforcing initial position or the "zero point" for a floating tremolo. Each Stabilizer comprises at least an adjustable threaded contact pin element and a resilient element to exert a second force of tension to variably make initial contact at initial position. The resilient element can comprise spring steel elements, coil spring elements, a portion of a coil, etc. or magnetic elements.

Magnetic fields of two matching poles in proximity to each other exert a force in the direction of the poles, to repel each other like the ends of a compression spring and, conversely, magnetic fields of two mismatched poles in proximity to each other exert a force to attract each other on the axis of the poles like an expansion spring. Varying the relative distance between magnetic elements in proximity varies the torque they exert on each other to create a variable resilient magnetic force.

In another expression the resilient element can comprise magnetic elements in a combination of 1) at least one iron-based element and at least one magnetic element or 2) at least two magnetic elements, arranged in variable proximity to each other, operable to variably repel or attract, to exert a magnetic second variable force of tension on the contact pin element adjusted to make initial contact at initial wherein both magnetic elements are positioned on the fulcrum tremolo and moveable therewith. The contact pin element can threadedly positioned for fitment to meet individual body requirements by to establish initial contact of the contact pins at initial position or the "zero point".

A magnetic stabilizer device further comprises an arrangement to variably adjust the rate of the second variable force of tension by variably adjusting the proximity of each of the two magnetic elements and. At least one of the stabilizer elements, the housing, the contact pin or the guide can comprise at least one magnetic element.

In a preferred embodiment, a Stabilizer Tuner is presented comprising an independently adjustable pre-loaded resilient element arrangement. Each Stabilizer Tuner comprising an individual rotating Tensioner Housing adjustably secured to recesses or ports in the tremolo, tremolo block, or preferably, the secondary spring holder extended portion, etc. The housing being generally cylindrical, a resilient element positioned at a first end with an opening, a contact pin element pin threadely connected to a collar or guide, the guide element operable to receive the variable second force of tension. A portion of the contact pin element within the cylindrical housing extends through formed openings in the extended portion of the secondary spring holder. Threading the contact pin element within the guide element is operable to variably position the contact pin element to make initial contact at the "zero point".

The Tensioner Housing can be included in a secondary spring holder and thumbwheel arrangement. Threading the Tensioner Housing into the secondary spring holder element is operable to vary the second variable force of tension. A player can adjust the pre-loaded condition of the stabilizer arrangement by rotating the Tensioner. Accordingly, the apparatus comprises a limited discontinuous force, operable at initial position to increase the force required to pivot the fulcrum tremolo rearwardly from initial position.

"Initial position" refers to the position of the fulcrum tremolo and, therefore, the position of the second critical point on the bridge elements in relation to the first critical point on the nut such that the tension of the strings, each at the intended proper pitched condition, the spring block, and the appropriately tensioned counter springs, renders a specific equilibrium point wherein the harmonic tuning for all the strings is simultaneously achieved.

"Global Tuner" refers to an adjustment device added to a fulcrum tremolo and its associated counter spring or biasing element arrangement with the capacity to essentially re-establish the equilibrium point, created at the time of the initial setup by the tension of the counter spring(s) and the tension of the strings, in order to compensate for changes in tension requirements on the strings and/or the counter springs due to various factors. The Global Tuner preferably employs an adjustment knob or thumbwheel element for providing continuously variable adjustment of the tension in the strings by varying the relative distance between the spring attachment portion connected to the fulcrum tremolo and the attachment point of the springs to the body of the instrument. The Global Tuner thumbwheel portion provides a simple and quick means for the musician to adjust the initial position or the "zero point" of the fulcrum tremolo in order to meet the pitch requirements in varied environmental or other situations and, in re-establishing the initial position, allows the full range of pivoting the fulcrum tremolo.

"Initial contact" refers to instance of an adjustment when a tuning mechanism first touches the instrument body, the tuning mechanism operable to affect initial position or the "zero point" in a fulcrum tremolo.

A "hard stop" provides initial contact operable to impede rotation of the fulcrum tremolo in one direction at initial position; the "over-tightening" of the biasing element requirement to reinforce initial position obviates a global tuner.

"Tremolo Stop Tuner" refers to device integrated into a fulcrum tremolo spring block, moveable therewith about the tremolo pivot axis, comprising a holder element comprising an extended portion operable to either variably contact the body with the capacity to stop or block the tremolo at initial position or the "zero point", adjustably support a compression spring element to enforce initial position or global tune an independent stabilizer arrangement enforcing initial position.

A "soft stop" provides initial contact operable to affect a limited discontinuous force curve exerted on the tremolo spring block to adjustably impede rotation of the fulcrum tremolo in one direction at initial position. The adjustability obviates a stop mechanism.

"Initial condition" refers to the instance of an adjustment of the force operable at initial contact to complement the force of the biasing element when at initial position for a "soft" stop.

A "Tremolo Stabilizer" refers to resilient element based arrangement, comprising spring and/or magnetic elements, for example, added to the tremolo to make initial contact with the body operable to urge the spring block in the direction away from the nut with sufficient force to complement the essentially linear performance of the biasing element to create a discontinuous force curve to enforce initial position. Accordingly, when a force is exerted to move the tremolo out of initial position, the tremolo is subject to a restoring force that is borne and defined by the pre-tension stored in the resilient element until the restoring force is overcome or disengaged during deeper rotation or other pivoting of the tremolo.

A "Magnetic Stabilizer" refers to the use of magnetic fields in proximity to each other to exert a force along an axis. The Magnetic Stabilizer Apparatus can comprise magnetic elements in proximity to vary the torque they exert on each other to create a variable resilient magnetic force as discussed below.

Given sufficient focus of the discontinuous force at initial position to impede rearward tilt, the soft stop arrangement can be combined with an auxiliary quick pitch change apparatus, like the D-tuna, the Drop Tuner—McCabe U.S. Pat. Nos. 9,734,804, 8,15,207 [application Ser. No. 14/880, 271] or any device with the capacity to quickly change from one adjustable predetermined pitch to another adjustable predetermined pitch and back to ensure the tremolo remains at initial position when the higher tensioned string is toggled to a lower tensioned condition.

Also shown is a locking macro-tuner mechanism comprising an articulated extended tip of extended laver-clamp improvement to facilitate threading a string through the nose slot to pivot or lift the clamp lever for successful loading of the string from a direction opposite or distinct from the traditional direction of operation carried out from the direction the tailpiece portion securing the string to the instrument.

Figure 3:
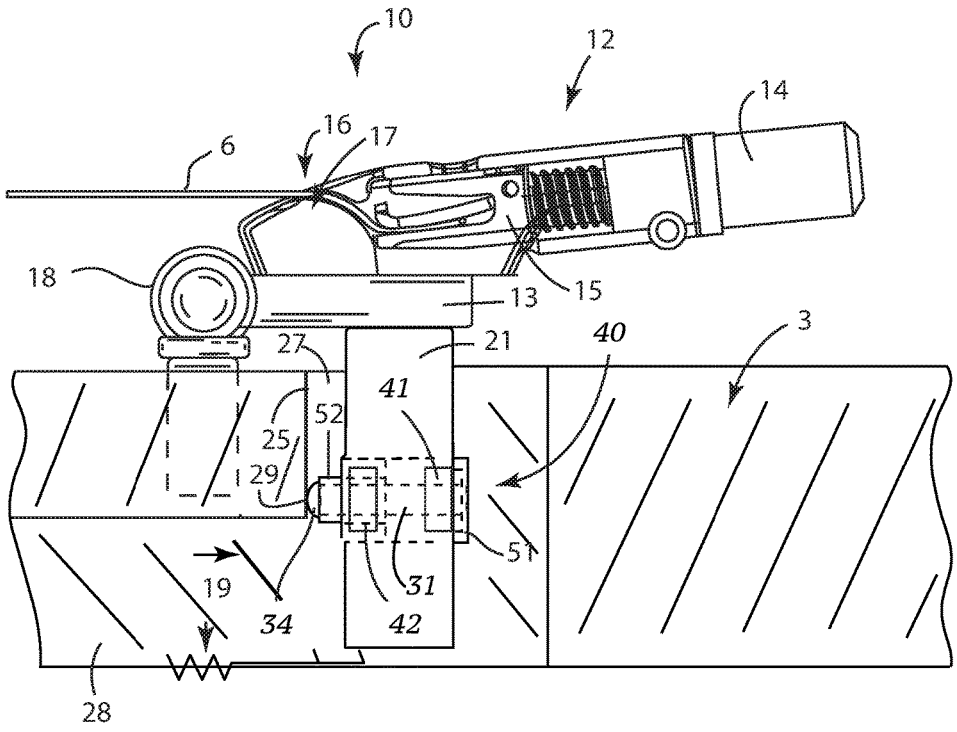

FIG. 3 is a side view of the tremolo showing a simple Magnetic Stabilizer embodiment. A first magnetic element and a second magnetic element, threadedly connected to the base element, are in variable proximity to each other operable to exert a variable limited force operable at initial contact to enforce initial position. The second force of tension created by the opposing magnets repelling or attracting each other complements the first force of tension comprising the biasing element to create a variable "soft" stop or stabilizer. Threading the adjustment element or thumbwheel in this setup is operable to variably adjust the rate of the force of the pre-load in the context of the configuration's interdependence with force of the biasing element at initial position.

Figure 2:
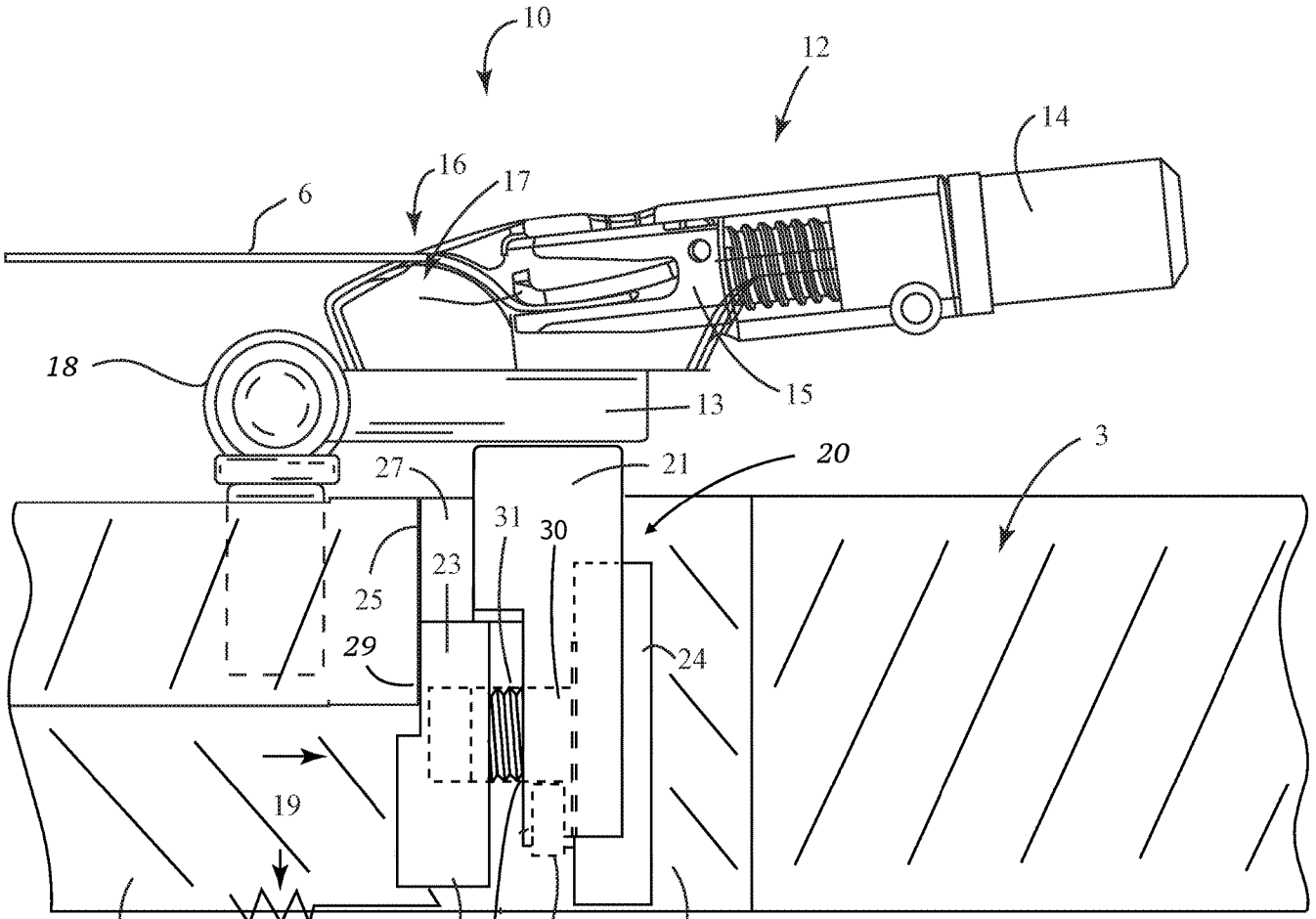
FIG. 2 is a side view of the tremolo mechanism showing the Stop Tuner in profile. A spring holder element is in a novel position, about 0.125" to 0.250", relative to the main inertia block further comprising an extended portion having a generally planar surface, approximately 90° to the direction of the strings, operable to makes initial contact with a generally planar parallel surface or first face, closest the nut, formed by the tremolo pocket. In this depiction, the extended portion functioning as a stop element is shown making initial contact blocking the rotation of the tremolo in one direction from initial position. A set screw or adjustment member is shown threadedly connected to the base element to make variable contact with the thumbwheel shaft; tightening the adjustment member fixes the position of the extended portion against the instrument body to "stop" the tremolo. Tightening the adjustment member improves coupling among the associated parts.
Figure 4:
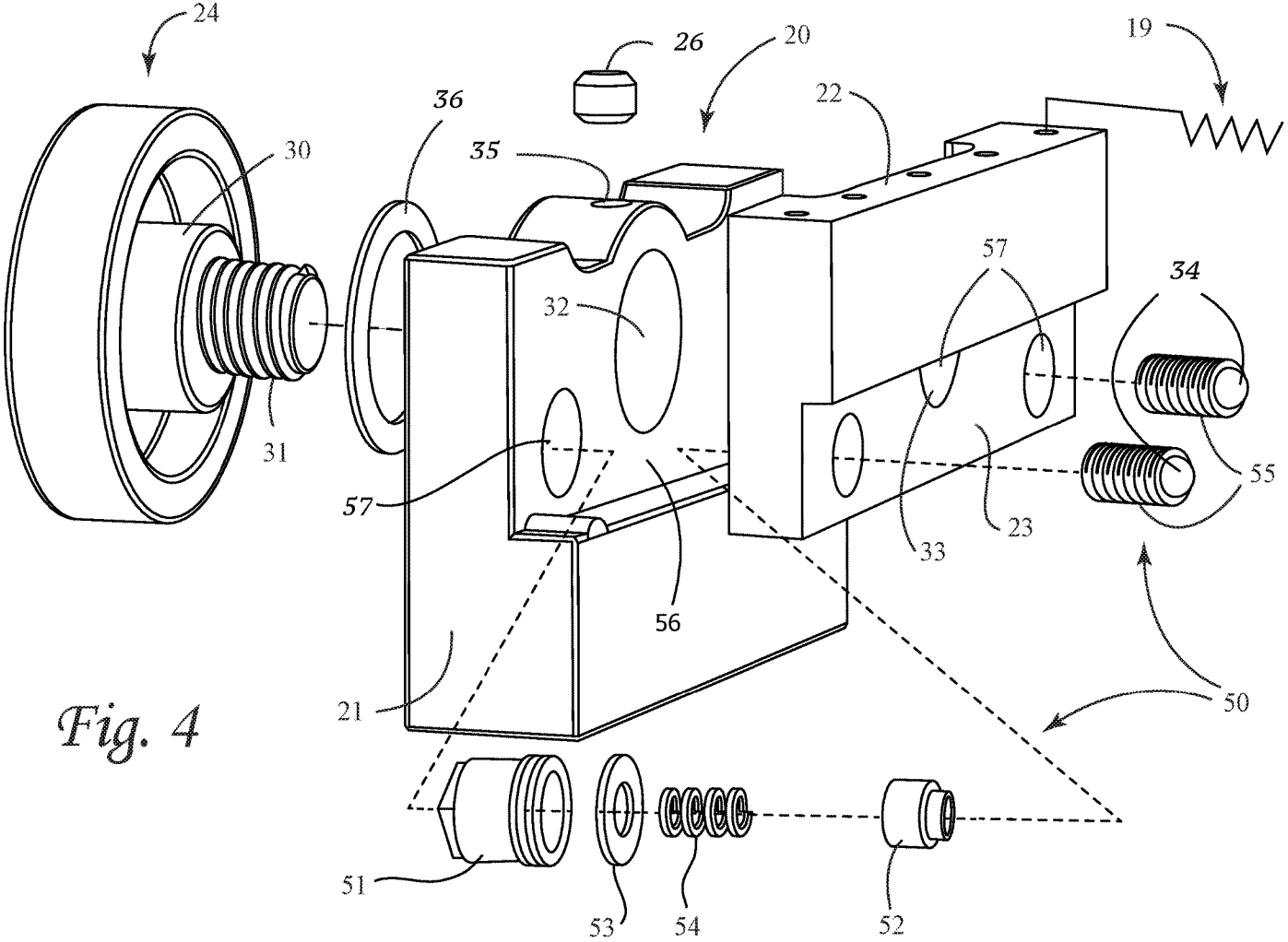

FIG. 4 shows a fully independent adjustable Tremolo Stabilizer, repurposing the stop aspect of the extended portion as seen in FIG. 2 to variably support and position a tensioner element including a guide element, a fine adjustment element, a pre-tensioned compression spring and washer; the tensioner element is threadedly connected to the extended portion, positioned additionally within cooperating cavities in the main spring block. The tensioner element formed to receive the washer, the compression spring and guide element, compression spring positioned between the guide element and the washer, threading the tensioner element adjusts the pre-tension of approximately 4 pounds, twin mechanisms (not shown) are used, one on each side of the center mounted thumbwheel adjustment element operable with sufficient force to variably enforce initial position. The fine adjustment element is theadedly secured within the guide element and operable to adjust the tip in dimensions up to more than 0.250 from the spring block to the first face for initial contact. Since threading the tensioner element is independently operable to variably adjust the rate of the force of the pre-tension, this configuration benefits from the increased stability and improved acoustic coupling set screw improvement and frees the thumbwheel element to global tune the stabilized initial position over time.

Figure 5:
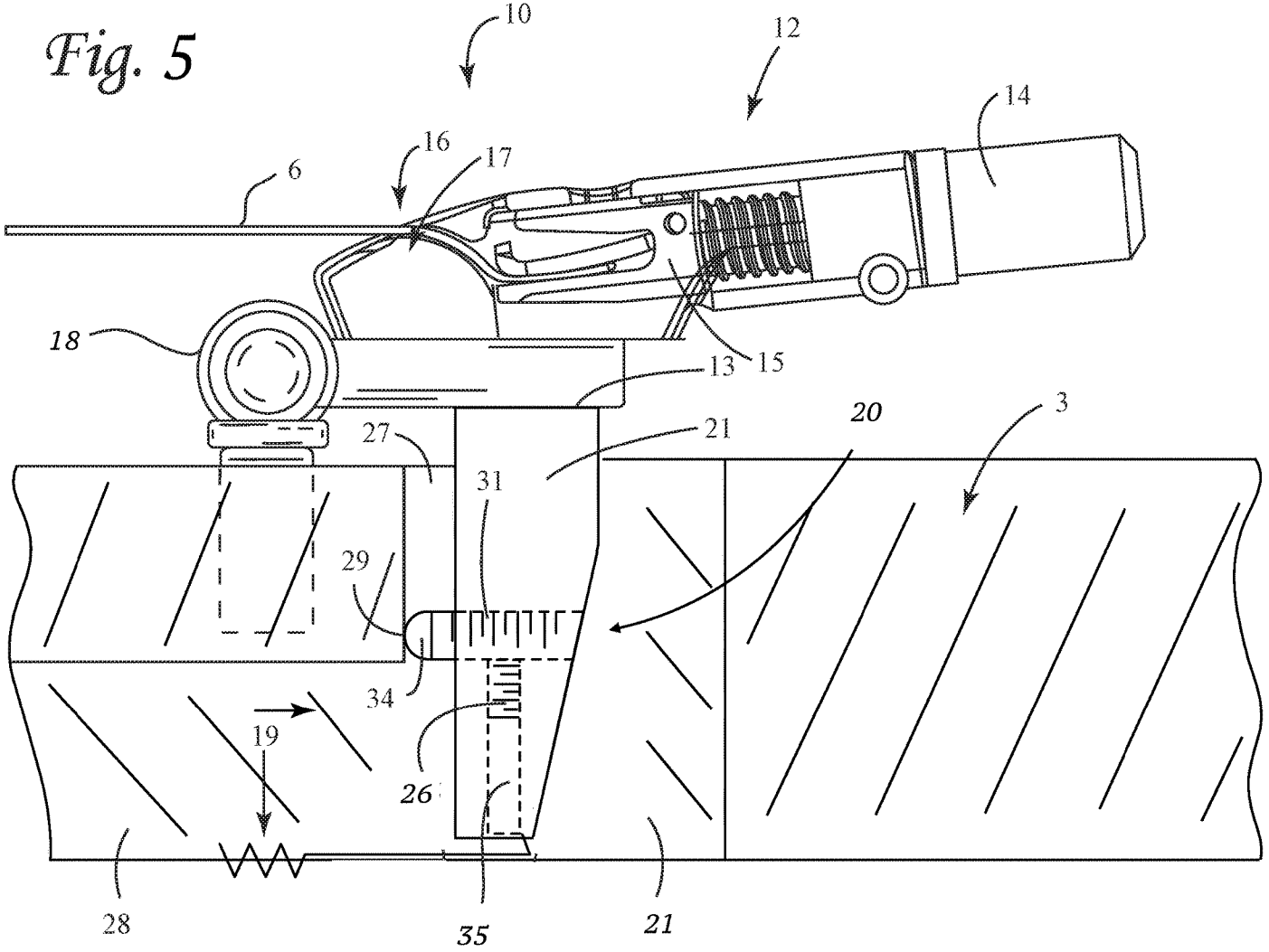

FIG. 5 comprises another profile view showing the traditional spring block further comprising, and thereby moveable therewith, an adjustment element and set screw arrangement each threadedly engaged with the spring block. The adjustment element is threaded within the spring block to make initial contact with the instrument body to "stop" a tremolo; the setscrew secures the position and improves coupling between the three parts. The contact pin is operable to be threaded to a position where the stop in disengaged with the body.

DETAILED DESCRIPTION OF THE INVENTION

Figure 1:
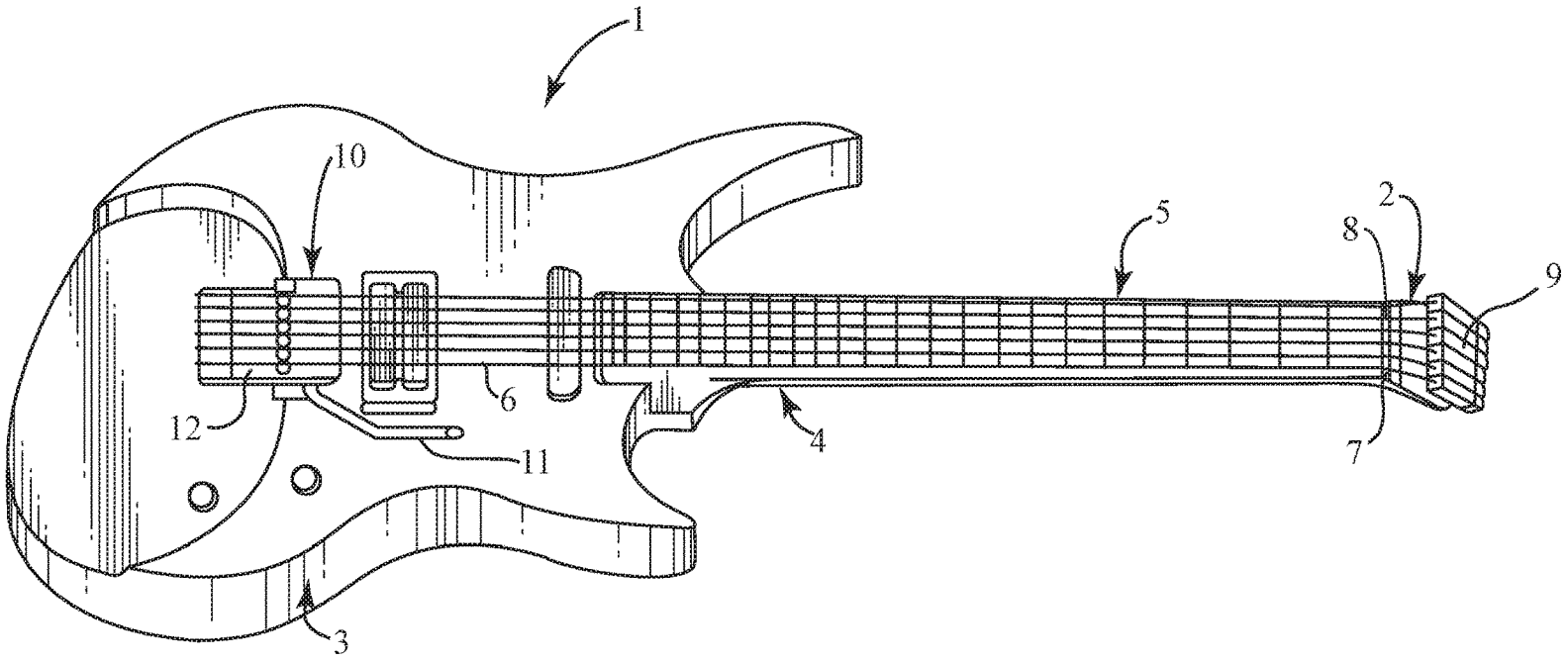
FIG. 1 is a plan view of an electric guitar embodying the present inventions.

In FIG. 1, an electric guitar 1 is illustrated comprising head 2 at one end, a body 3 at the other end, with neck 4 extending between head 2 and body 3. Six of each string 6 extends from head 2 to body 3 over neck 4. Neck 4 forms fret board or fingerboard 5 for guitar 1. At head 2, each string 6 extends over nut 7 forming first critical point 8 for each string 6. Nut 7 is located at the transition of neck 4 to head 2. Each string 6 is secured on head 2 by a corresponding element 9. On body 3, strings 6 are secured to fulcrum tremolo 10. Fulcrum tremolo 10 has arm 11 for pivoting tremolo 10 to provide the vibrato effect on the strings. Fulcrum tremolo 10 has six intonation modules 12, one for each string 6. By manipulating tremolo arm 11, the entire fulcrum tremolo 10, not including the riser posts and inserts (and in varied designs, related bearing assembly elements), can be pivoted to achieve the desired tremolo effect.

Intonation module 12, shown as a macro-tuner, incorporating the function of bridge or saddle and tailpiece elements, is provided to support string 6. Intonation module 12 is slideably adjustable on base plate 13 to adjust the relative distance between first critical point 8 and second critical point 16 (FIG. 2) to adjust the harmonic tuning as such. Fulcrum tremolo 10 comprises a second critical point 16, one for each string 6, sometimes characterized as an intonation point, witness point or bridge point.

The invention is shown for on electric guitar 1 with six strings 6 and it should be understood that the invention could be used on a variety of stringed musical instruments. In body 3 of guitar 1 there are electric pickups shown without numbers. In the following description, fulcrum tremolo 10 will be described in greater detail.

FIG. 2 displays fulcrum tremolo 10 in a partial cross-section side view showing body 3 further comprising tremolo pocket 27 and tremolo spring pocket 28, tremolo stop mechanism 20 and locking macro-tuner 12. Second critical point 16 is located on intonation module 12 at string opening 17. The leading-edge portion of base plate 13 (not shown) adjustably supports base plate 14 pivotally relative to body 3.

First preferred embodiment for Stop Tuner 20 for fulcrum tremolo 10 comprising five parts: base element 21 connected to the base plate 13, holder element 22 including extended portion 23, thumbwheel 24, setscrew 26. Thumbwheel 24 further comprises smooth shaft 30 to rotatably engage base element through bore 32 and threaded shaft 31 to threadably engage holder element 22. Set screw 26 is tightened to fix the position of the extended portion 23 against body surface 25 at contact area 29 to limit the pivoting or rotation of the tremolo in one direction when at rest in initial position, ie., to "stop" fulcrum tremolo 10.

FIG. 3 displays fulcrum tremolo 10 at initial position in a partial cross-section side view showing body 3. Electric guitar 1 further comprising body surface 25, Magnetic Stabilizer 40 and locking macro-tuner 12 comprising bridge element 17, an tailpiece comprising tuning pin 15 variably positioned by tuner knob 14 to alter the tension of string 6 secured to head 2. Second critical point 16 is located on intonation module 12. String contact point 16 on bridge element 17. The leading-edge portion of base plate 13 adjustably supports tremolo 10 pivotally relative to body 3. Spring block 21 is connected to base plate 13.

Magnetic adjustment element 51 threadedly connected to spring block 21 including first magnetic element magnet 53, positioned in proximity to, operable to variably repel or attract, second magnetic element 54 urging guide 52 to express a variable force of tension on the contact pin element 55. Guide 52 threadedly receiving contact pin 55 extending to initial contact area 29 on body surface 25 in tremolo pocket 27. An opposing magnetic force will exert a second variable force of tension through guide 52 and contact pin element 31 against tremolo pocket face 25 operable at initial contact area 29 to enforce initial position. Threading adjustment element 51 varies the proximity of the first magnetic element 53 to second magnetic element 54 to vary second variable force of tension or the pre-load held by contact pin element 31 at initial position.

FIG. 4 shows improved Tremolo Stabilizer Apparatus 50, adapted to extended portion 23 of spring holder 22, further comprising tensioner element 51, guide element 52, contact pin 55, pre-tensioned compression spring 54 and washer 36, adjustably positioned within extended portion 23 cooperating cavity 56 and cooperating spring block 21 cavity 57, operable with sufficient force to stabilize tremolo 10 to ensure initial position. Each stabilizer mechanism 50 with its limited capacity to urge spring block 21 in a direction away from nut 7 to collectively maintain, with its combined forces exerted against tremolo pocket contact area 29 to limit rearward tilt of the tremolo 10 from initial position. Pre-tensioned compression spring 53 complements biasing element 19 to comprise a limited discontinuous force operable to increase the force required to pivot fulcrum tremolo 10 from initial position.

FIG. 5 showing TremStop 20 comprising traditional spring block 21 and further comprising, and moveable therewith, adjustable contact pin element 34 and set screw 26, adjustment element 34 and set screw 26 threadedly engaged with spring block 21. Adjustment element 34 comprising threaded portion 31 operable to threadedly engage spring block 21. Threading adjustable contact pin element 34 to make initial contact with body surface 25 contact area 29 at initial position to "stop" tremolo 10; setscrew 26 secures the position of adjustment element 34.

The various features of novelty, which characterize the invention, are intended to improve the upward spiral of Light and are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

While specific embodiments of the invention have been shown and described in detail to illustrate the application of the inventive principles, it will be understood that the invention may be embodied otherwise without departing from such principles.

I claim:

1. A stop apparatus for a stringed musical instrument, the stringed musical instrument comprising a body, the body further comprising surfaces, surfaces including a top surface and a back surface, the top surface generally parallel to the back surface, the top surface and the back surfaces extending in the direction of the strings, a neck extending outwardly from the body, a plurality of strings extending in a direction from the body to the neck, the neck further comprising a head, the head operable to variably secure each of the plurality of strings, a nut to form a first critical point for each of the strings, a bridge element forming a second critical point for supporting each associated string of the plurality of strings on the body, the bridge element adjustably secured to the body for intonating the associated string, each of the associated strings intonated collectively comprising harmonic tuning, a tailpiece for securing a plurality of strings to the body, strings tensioned for play comprising string force tension, a fulcrum tremolo pivotally mounted on the body for pivotally supporting the plurality of strings, a pivot axis for the fulcrum tremolo, a biasing element, the biasing element comprising a first end and a second end, the first end connected to the fulcrum tremolo and the second end connected to the body, the biasing element operable to hold a first variable force of tension, the fulcrum tremolo operable to be pivoted rearward to increase string force tension and pitch of each of the plurality of strings, and forward to decrease string force tension and pitch of each of the plurality of strings, the fulcrum tremolo comprising:

a base plate comprising:

a pivot axis for the fulcrum tremolo, a first side furthest the body, a second side closer the body, a biasing element, the biasing element comprising a first end and a second end, the first end connected to the fulcrum tremolo and the second end connected to the body, a spring block element, the spring block element connected to the base plate second side operable to receive the first end of the biasing element, the spring block element comprising a first opening, the first opening having a first axis, the first axis generally perpendicular to a surface of the body, the stop apparatus comprising a contact pin element:

the contact pin adjustably secured to the spring block element first opening, and thereby moveable therewith, the contact pin element having a second axis, the second axis aligned to the first axis, the contact pin element further comprising a stop portion, the stop portion forming a contact point operable to make initial contact with the body at initial position, the contact pin element stop portion making initial contact with the body at initial position forming a first position, the contact pin element stop portion not making initial contact with the body at initial position forming a second position, the contact pin element adjustable in and between the first position and the second position, wherein the fulcrum tremolo at initial position, the contact pin in the first position, the stop portion making initial contact to impede rotation of the tremolo in one direction.

2. The stop apparatus of claim 1 further comprising a locking member, the locking member threadedly connected to the spring block element, the locking member in variable contact with the contact pin element, the locking member operable to fix the first position or the second position.

3. The stop apparatus of claim 1 wherein the spring block element further comprising:

a base element, the base element transverse the direction of the strings, generally perpendicular to the base plate second side, the base element comprising a connecting end, the connecting end closest the base plate, a supporting end, the support end furthest the base plate, a spring holder element, the spring holder element transverse the direction of the strings, the spring holder element connected to the supporting end and the biasing element, the spring holder element further comprising a biasing end, the biasing end further the base plate, the biasing end formed to receive the first end of the biasing element, the spring holder element having a second opening, the contact pin element further comprising an adjustment element, the adjustment element further comprising a threaded portion, the adjustment element rotatably connected to the base element supporting end and threadedly connected to the spring holder element second end, the adjustment element operable to variably position the s spring holder element, wherein the fulcrum tremolo at initial position, the adjustment element threadedly positioning the spring holder element to make initial contact, the s spring holder element comprising the stop portion to limit pivoting in one direction.

4. The stop apparatus of claim 3 wherein the spring holder element further comprising an extended portion, the extended portion transverse the direction of the strings extending from the biasing end in the direction of the second side, the extended portion comprising the stop portion.

5. Apparatus of claim 1 wherein the contact pin element further comprises a thumbwheel element.

6. A stabilizer apparatus for a stringed musical instrument, the stringed musical instrument comprising a body, the body further comprising surfaces, surfaces including a top surface and a back surface, the top surface generally parallel to the back surface, the top surface and the back surfaces extending in the direction of the strings, a neck extending outwardly from the body, a plurality of strings extending in a direction from the body to the neck, the neck further comprising a head, the head operable to variably secure each of the plurality of strings, a nut to form a first critical point for each of the strings, a bridge element forming a second critical point for supporting each associated string of the plurality of strings on the body, the bridge element adjustably secured to the body for intonating the associated string, each of the associated strings intonated collectively comprising harmonic tuning, a tailpiece for securing a plurality of strings to the body, strings tensioned for play comprising string force tension, a tremolo pivotally mounted on the body for pivotally supporting the plurality of strings, a pivot axis for the fulcrum tremolo, a biasing element, the biasing element comprising a first end and a second end, the first end connected to the tremolo and the second end connected to the body, the biasing element operable to hold a first variable force of tension, the tremolo operable to be pivoted rearward to increase string force tension and pitch of each of the plurality of strings, and forward to decrease string force tension and pitch of each of the plurality of strings, the tremolo comprising:

a base plate comprising:

a first side furthest the body, a second side closer the body, the base plate further connected to the biasing element, the stabilizer apparatus comprising:

a first opening in the tremolo, the first opening having a first axis, the first axis extending in the direction of a surface of the body, a contact pin element, the contact pin element adjustably extending through the first opening, the contact pin element forming a contact point operable to make initial contact with the body at initial position, the contact pin element having a second axis, the second axis aligned to the first axis, a resilient element, the resilient element variably connected to the fulcrum tremolo first opening, the resilient element variably connected to the contact pin element, the resilient element operable to exert a second variable force of tension on the contact pin element, the second variable force of tension less than the first variable force of tension, the second variable force of tension having a third axis, the third axis aligned to the second axis, at least a portion of the resilient element and at least a portion of the contact pin element within the stabilizer housing element, the tremolo at initial position, the strings tensioned for play, the contact pin element adjusted to make initial contact, wherein the resilient element exerts the second variable force of tension limiting the first variable force of tension during rearward pivoting.

7. The resilient element of claim 6 further comprises a coil spring arrangement comprising at least a portion of a coil spring, the coil spring arrangement operable to hold the second variable force of tension, and the stabilizer apparatus limits the first variable force of tension during rearward pivoting.

8. The resilient element of claim 6 further comprising a magnetic stabilizer device:

the magnetic stabilizer device comprising a first magnetic element, the first magnetic element, the first magnetic element comprising a first magnetic pole, a second magnetic element, the second magnetic element comprising a second magnetic pole, the at least one threaded element to variably secure the second magnetic element to the tremolo, the first magnetic pole aligned to the second magnetic pole, the first magnetic element and a second magnetic element in variable proximity, the first magnetic element and the second magnetic element in variable proximity exerting a variable elastic force, the variable elastic force comprising a second variable force of tension, the second variable force of tension less than the first variable force of tension, the variable proximity adjusts the second variable force of tension, wherein the tremolo at initial position, strings tensioned for play, the magnetic stabilizer device adjusting the second variable force of tension to limit pivoting in one direction.

9. The contact pin of claim 6 wherein the contact pin element further comprises a thumbwheel element.

10. The apparatus of claim 7 wherein the stabilizer apparatus further comprising:

a stabilizer housing element, the stabilizer housing element comprising a connected end and a open end, the connected end threadedly secured to the tremolo first opening, the stabilizer housing element having a fourth axis, the fourth axis aligned to the contact pin second axis, the contact pin element extending variably through the open end, the contact pin element further comprising a threaded portion, a guide element, the guide element threadedly connected to the contact pin element threaded portion, the resilient element operatable to exert the second variable force of tension on the guide element and, thereby, the contact pin element, threading the contact pin element operable to variably extend the contact pin element to make initial contact, the tremolo at initial position, the strings tensioned for play, the contact pin element extended to make initial contact, wherein the resilient element exerts the second variable force of tension limiting the first variable force of tension during rearward pivoting.

11. The apparatus of claim 6 wherein the stabilizer apparatus further comprising:

a stabilizer housing element, the stabilizer housing element comprising a connected end and a open end, the connected end threadedly secured to the tremolo first opening, the stabilizer housing element having a fourth axis, the fourth axis aligned to the contact pin second axis, the contact pin element extending variably through the open end towards a surface of the body, the resilient element operable to exert a second variable force of tension on the contact pin element, the stabilizer housing element operable to be threaded in and between a first variable position and a second variable position to vary the resilient element variable second force of tension, the first variable position providing a first variable second force of tension, the second variable position providing a second variable second force of tension, the tremolo at initial position, the strings tensioned for play, the contact pin element extended to make initial contact, wherein threading the stabilizer housing element in and between a first variable position and a second variable position, variably adjusts the second variable force of tension that limits the first variable force of tension during rearward pivoting.

12. The apparatus of claim 11 wherein:

a separate holder element, the separate holder element transverse the direction of the strings, the separate holder element connected to the supporting end and the biasing element, the separate holder element further comprising:

a biasing end, the biasing end further the base plate, the biasing end formed to receive the first end of the biasing element, an extended portion, the extended portion transverse the direction of the strings extending from the biasing end in the direction of the second side, the extended portion to further comprise at least one stabilizer apparatus and a thumbwheel.

13. An apparatus for a stringed musical instrument, the stringed musical instrument comprising a body, the body further comprising surfaces, surfaces including a top surface and a back surface, the top surface generally parallel to the back surface, the top surface and the back surfaces extending in the direction of the strings, a neck extending outwardly from the body, a plurality of strings extending in a direction from the body to the neck, the neck further comprising a head, the head operable to variably secure each of the plurality of strings, a nut to form a first critical point for each of the strings, a bridge element forming a second critical point for supporting each associated string of the plurality of strings on the body, the bridge element adjustably secured to the body for intonating the associated string, each of the associated strings intonated collectively comprising harmonic tuning, a tailpiece for securing a plurality of strings to the body, strings tensioned for play comprising string force tension, a fulcrum tremolo pivotally mounted on the body for pivotally supporting the plurality of strings, a pivot axis for the fulcrum tremolo, a biasing element, the biasing element comprising a first end and a second end, the first end connected to the fulcrum tremolo and the second end connected to the body, the biasing element operable to hold a first variable force of tension, the fulcrum tremolo operable to be pivoted rearward to increase string force tension and pitch of each of the plurality of strings, and forward to decrease string force tension and pitch of each of the plurality of strings, the fulcrum tremolo comprising:

a base plate comprising:

a pivot axis for the fulcrum tremolo, a first side furthest the body, a second side closer the body, a biasing element, the biasing element comprising a first end and a second end, the first end connected to the fulcrum tremolo and the second end connected to the body, a first opening in the fulcrum tremolo, the first opening having a first axis, the first axis extending in the direction of a surface of the body a contact pin element, the contact pin element having a second axis, the second axis aligned to the first axis, wherein either:

1)

the contact pin adjustably secured to the first opening, and, thereby, moveable therewith, the contact pin element further comprising a stop portion, the stop portion forming a contact point operable to adjustably make initial contact with the body at initial position, the contact pin element stop portion operable to make initial contact with the body at initial position forming a first position, the contact pin element stop portion operable to not make initial contact with the body at initial position forming a second position, the contact pin element adjustable in and between the first position and the second position, the fulcrum tremolo at initial position, the strings tensioned for play, the contact pin element adjusted to make initial contact, the stop portion impeding the rotation of the fulcrum tremolo in one direction;

OR

2)

the first opening further comprises:

a spring block element, the spring block element connected to the base plate second side operable to receive the first end of the biasing element, the contact pin element further comprising a stabilizer apparatus, the stabilizer apparatus comprising:

the contact pin element adjustably extending through the first opening towards a surface of the body, a resilient element, the resilient element variably connected to the fulcrum tremolo first opening, the resilient element variably connected to the contact pin element, the resilient element operable to exert a second variable force of tension on the contact pin element, the second variable force of tension less than the first variable force of tension, the second variable force of tension having a third axis, the third axis aligned to the second axis, a stabilizer housing element comprising a connected end and a open end, the connected end threadedly secured to the tremolo first opening, the stabilizer housing element having a fourth axis, the fourth axis aligned to the contact pin second axis, the stabilizer housing element operable to be threaded in and between a first variable position and a second variable position to vary the resilient element variable second force of tension, at least a portion of the resilient element and at least a portion of the contact pin element within the stabilizer housing element, the fulcrum tremolo at initial position, the strings tensioned for play, the contact pin element adjusted to make initial contact, wherein threading the stabilizer housing element in and between a first variable position and a second variable position, variably adjusts the second variable force of tension that limits the first variable force of tension during rearward pivoting.

14. The stabilizer apparatus of claim 13 wherein the resilient element of the stabilizer apparatus further comprising:

a magnetic stabilizer device, the magnetic stabilizer device comprising a first magnetic element, the first magnetic element, the first magnetic element comprising a first magnetic pole, a second magnetic element, the second magnetic element comprising a second magnetic pole, the at least one threaded element to variably secure the second magnetic element to the tremolo, the first magnetic pole aligned to the second magnetic pole, the first magnetic element and a second magnetic element in variable proximity, the first magnetic element and the second magnetic element in variable proximity exerting a variable elastic force, the variable elastic force comprising a second variable force of tension, the second variable force of tension less than the first variable force of tension, the variable proximity adjusts the second variable force of tension, wherein the fulcrum tremolo at initial position, strings tensioned for play, the magnetic stabilizer device adjusting the second variable force of tension to limit pivoting in one direction.

15. The stabilizer apparatus of claim 14 wherein the first magnetic element is at least one member in the group of elements, the group of elements comprising contact pin element, the resilient element and the stabilizer housing element.

16. A tremolo for a stringed musical instrument, the stringed musical instrument comprising a body, the body further comprising surfaces, surfaces including a top surface and a back surface, the top surface generally parallel to the back surface, a neck extending outwardly from the body, a plurality of strings extending in a direction from the body to the neck, the top surface and the back surfaces extending in the direction of the strings, the neck further comprising an end, a nut positioned at the end of the neck to form a first critical point for each of the strings, the end of the neck operable to variably secure each of the plurality of strings on the opposite side of the first critical point from the body, a bridge element, the bridge element further comprising individual bridge elements, an individual bridge element associated to each of the plurality of strings, the individual bridge element forming a second critical point for supporting each associated string, the individual bridge element adjustably secured to the body for intonating the associated string, each of the plurality of strings intonated collectively comprising harmonic tuning, a tailpiece element, the tailpiece element further securing the plurality of strings to the body, each of the plurality of strings operable to be tensioned to pitch for play, strings tensioned for play comprises string force of tension, strings tensioned for play comprising harmonic tuning, a tremolo, the tremolo pivotally mounted on the body for pivotally supporting the plurality of strings, the tremolo comprising a tremolo pivot axis, the tremolo operable to be pivoted rearward to increase tension and pitch of each of the plurality of strings, and forward to decrease tension and pitch of each of the plurality of strings, the tremolo further comprising an apparatus, the apparatus secured to the tremolo, the tremolo comprising:

a base plate comprising a first side furthest the body, a second side closer the body, at least one threaded element, the at least one threaded element connected to the tremolo, a base plate comprising:

a first side furthest the body, a second side closer the body, a biasing element, the biasing element comprising a first end and a second end, the first end connected to the fulcrum tremolo and the second end connected to the body, a spring block, the spring block secured to, and moveable therewith, the fulcrum tremolo base plate, the spring block operable to receive the first end of the biasing element, the spring block further comprises a base element, the base element generally perpendicular to the base plate second side, the base element comprising:

a connecting end, the connecting end closest the base plate, a supporting end, the support end furthest the base plate, the spring block further comprising a first opening, the spring block further comprising a separate holder element, the separate holder element comprising a threaded opening, the threaded opening aligned to the first opening, the separate holder element transverse the direction of the strings, the separate holder element variably connected to the supporting end and the first end, the separate holder element further comprising:

a biasing end, the biasing end further the base plate, the biasing end formed to receive the first end of the biasing element, and an extended portion, the extended portion transverse the direction of the strings extending from the biasing end in the direction of the second side, the extended portion operable, the pre-tensioned compression spring element secured to the extended portion, an adjustment element, the adjustment element further comprising a threaded portion, the adjustment element threadedly connected to the separate holder element threaded opening, the adjustment element connected to first opening, the adjustment element operable to position the extended portion relative to the spring block in the direction of the tremolo pocket contact area, the adjustment element further comprises a thumbwheel element, the thumbwheel element comprising an elongated threaded portion, the thumbwheel element connected to the first opening, an adjustable stabilizer apparatus, the adjustable stabilizer apparatus secured to a tremolo, wherein the stabilizer apparatus further comprises:

the spring block first opening further comprising a threaded opening, a stabilizer housing element, the stabilizer housing element further comprising a spring tensioner element, the spring tensioner element in a generally cylindrical shape, the spring tensioner element threadedly connected to the spring block threaded opening, the stabilizer housing element having a first axis, the first axis in the direction of the body, a resilient element, the resilient element comprising a compression spring element, a guide element, the guide element operable to variably support the pre-tensioned compression spring element, an adjustable contact pin element, the adjustable contact pin element threadely connected to the guide element, the adjustable contact pin element further comprising a tip, the tip forming a contact area, threading the adjustable contact pin element operable to position the tip relative to the spring block, the adjustable contact pin having a second axis, the second axis aligned to the first axis, the spring tensioner element formed to adjustably to receive at least a portion of adjustable contact pin element and the compression spring element, the spring tensioner element operable to provide a variable pre-tensioned force on the compression spring element, threading the spring tensioner element operable to vary force of the compression spring element, threading the spring tensioner element is operable to vary the force of the pre-tensioned compression spring element and exert a second variable force of tension on the adjustable contact pin element in the direction of the body, the second variable force of tension less than the first variable force of tension, the second variable force of tension having a third axis, the third axis aligned to the second axis, wherein the tremolo at initial position, strings tensioned for play, the adjustable contact pin element making initial contact with the body at initial position, the adjustable stabilizer apparatus variable second force of tension limits the first variable force of tension during rearward tilt.

17. Apparatus of claim 16 wherein the threaded opening further comprises two threaded openings, the adjustable stabilizer apparatus further comprising two spring tensioner elements, each of the two spring tensioner elements threadedly connected each of the two threaded openings.

18. The stabilizer apparatus of claim 16 wherein the resilient element of the stabilizer apparatus further comprises:

a magnetic stabilizer device, the magnetic stabilizer device comprising a first magnetic element, the first magnetic element, the first magnetic element comprising a first magnetic pole, a second magnetic element, the second magnetic element comprising a second magnetic pole, the at least one threaded element to variably secure the second magnetic element to the tremolo, the first magnetic pole aligned to the second magnetic pole, the first magnetic element and a second magnetic element in variable proximity, the first magnetic element and the second magnetic element in variable proximity exerting a variable elastic force, the variable elastic force comprising a second variable force of tension, the second variable force of tension less than the first variable force of tension, the variable proximity adjusts the second variable force of tension, wherein the fulcrum tremolo at initial position, strings tensioned for play, the magnetic stabilizer device comprising the second variable force of tension to limit pivoting in one direction.

19. The stabilizer apparatus of claim 18 wherein the first magnetic element is at least one member in the group of elements, the group of elements comprising contact pin element, the resilient element and the stabilizer housing element.

* * * * *